United States Patent [19]

DeBilly et al.

[11] Patent Number: 4,596,081

[45] Date of Patent: Jun. 24, 1986

[54] SIDE WING PLOW POSITIONER

[75] Inventors: Jacques DeBilly, St-Valérien; Daniel Dépeault, Upton; Bertrand Houle, Drummondville, all of Canada

[73] Assignee: Tenco Machinery Ltd., St-Valérien, Canada

[21] Appl. No.: 535,335

[22] Filed: Sep. 23, 1983

[51] Int. Cl.[4] ..... E01H 5/06

[52] U.S. Cl. ..... 37/281; 403/330

[58] Field of Search ..... 37/266, 274, 281, 271; 292/153; 403/106, 330

[56] References Cited

U.S. PATENT DOCUMENTS

| | | | |
|---|---|---|---|
| 2,101,666 | 12/1937 | Austin | 37/274 X |
| 2,193,532 | 3/1940 | Frink | 37/281 X |
| 2,643,470 | 6/1953 | Kaeser | 37/281 X |
| 3,450,425 | 6/1969 | Leonhardt | 403/330 X |
| 3,989,286 | 11/1976 | Cleff | 292/153 |
| 4,036,525 | 7/1977 | Howk | 403/106 X |

FOREIGN PATENT DOCUMENTS

| | | | |
|---|---|---|---|
| 609001 | 11/1960 | Canada | 37/266 |
| 6415138 | 6/1966 | Netherlands | 403/330 |
| 681182 | 8/1979 | U.S.S.R. | 403/330 |

*Primary Examiner*—Edgar S. Burr
*Assistant Examiner*—Moshe I. Cohen

[57] ABSTRACT

A side wing plow positioner for locating a wing plow in a retracted position against a vehicle without obstructing vision from an adjacent side window in a passenger cab of the vehicle. The positioner comprises an elongated guide track secured to a rear portion of the wing plow adjacent a discharge end thereof and in a substantially vertical position from a lower edge thereof. A slide member is engaged with the track for limited longitudinal displacement therealong. An arresting lug retains the slide member in a lower end portion of the track. A linkage is secured to the slide member for displacing it in the guide track. The arresting lug has an automatic actuation mechanism to arrest the slide member in the lower end portion.

12 Claims, 9 Drawing Figures

22
21
22
19
20
23
23
10
37
50
34
35
33
30
29
25
31
32
26'
27
15
24
28
40
26

24

24
41
36
40'
40
35

24
20
40
43
42
44
29

SIDE WING PLOW POSITIONER

BACKGROUND OF INVENTION (a) Field of the Invention

The present invention relates to a side wing plow positioner for locating a wing plow in a retracted position against a vehicle without obstructing vision from an adjacent side window in a passenger cab of the vehicle.

(b) Description of Prior Art

A major problem with the construction of side wing plows is that when the plow is retracted against the vehicle, it extends angularly upward against the side of a vehicle and totally obstructs the side window of the vehicle passenger cab. Accordingly, the visibility through the right side of the vehicle is substantially obstructed and thus it is difficult to see oncoming traffic or obstacles located to the right of the vehicle. Such side wing plow positioning has resulted in the cause of various automobile accidents and property damage. The reason for the plow being located as such is that the side booms attached to the plow are merely angulated upwardly on a lower pivot connection and it so happens that the length of these booms is such as to locate the plow against the side window area.

SUMMARY OF INVENTION

It is a feature of the present invention to provide a side wing plow positioner which substantially obviates the above-mentioned disadvantage of the prior art.

Another feature of the present invention is to provide a side wing plow positioner in which the side wing plow in the retracted position is located substantially horizontally without obstruction of the vision from an adjacent side window of the passenger cab of a vehicle.

Another feature of the present invention is to provide a side wing plow positioner which is easy to operate and which permits the side boom to be automatically relocked in position.

According to the above features, from a broad aspect, the present invention provides a side wing plow positioner for locating a wing plow in a retracted position against a vehicle without obstructing vision from an adjacent side window in a passenger cab of the vehicle. The positioner comprises an elongated guide track secured to a rear portion of the wing plow adjacent a discharge end thereof and in a substantially vertical position from a lower edge thereof. A slide member is engaged with the track for limited longitudinal displacement therealong. Arresting means is provided to retain the slide member in a lower end portion of the track. A displaceable linkage means is secured to the slide member for displacing the slide member along the guide track. The arresting means has an automatic actuation mechanism to arrest the slide member in the lower end portion of the track.

BRIEF DESCRIPTION OF DRAWINGS

A preferred embodiment of the present invention will now be described with reference to an example thereof as illustrated in the accompanying drawings in which.

DESCRIPTION OF PREFERRED EMBODIMENTS

Figure 1:
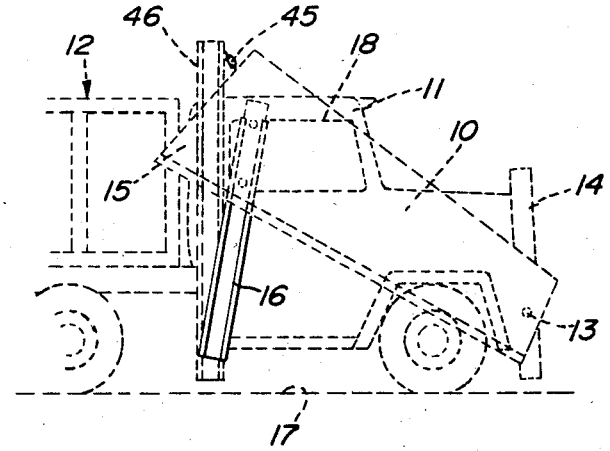
Fig. 1 (PRIOR ART)
FIG. 1 is a side view of a vehicle having a side wing plow in a retracted position as presently existing in the prior art.

Referring now to the drawings and more particularly to FIG. 1, as is known in the prior art, there is shown a side wing plow 10 secured to the side of a passenger cab 11 of a vehicle 12. The side wing plow is usually pivotally connected at 13 to a front frame 14 of the vehicle and is supported adjacent a discharge end 15 by booms or link arms 16 which are usually hydraulically operated to position the side wing plow at the proper angle with respect to a ground surface 17. When the wing plow is retracted, the link arms 16 pivot upwardly whereby the wing plow 10 is positioned adjacent a side window 18 of the vehicle.

Figure 2:
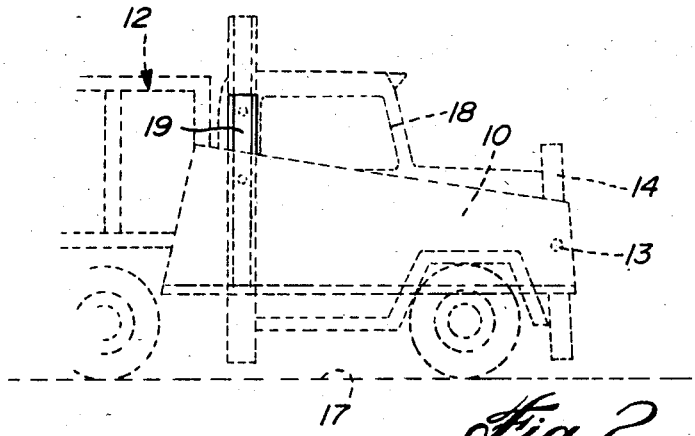
FIG. 2 is a side view of a vehicle wherein the retracted side wing plow is equipped with a positioner of the present invention.

FIG. 2 illustrates the side wing plow 10 equipped with a side wing plow positioner 19 of the present invention wherein the side wing plow when in its retracted position lies in a substantially horizontal plane below the side window 18 of the vehicle 12. The front end of the plow 10 is also located on a hydraulically actuated pivot connection 13 and is movable up and down on the front frame 14. This front pivot connection 13 is well known in the art.

Figure 3:
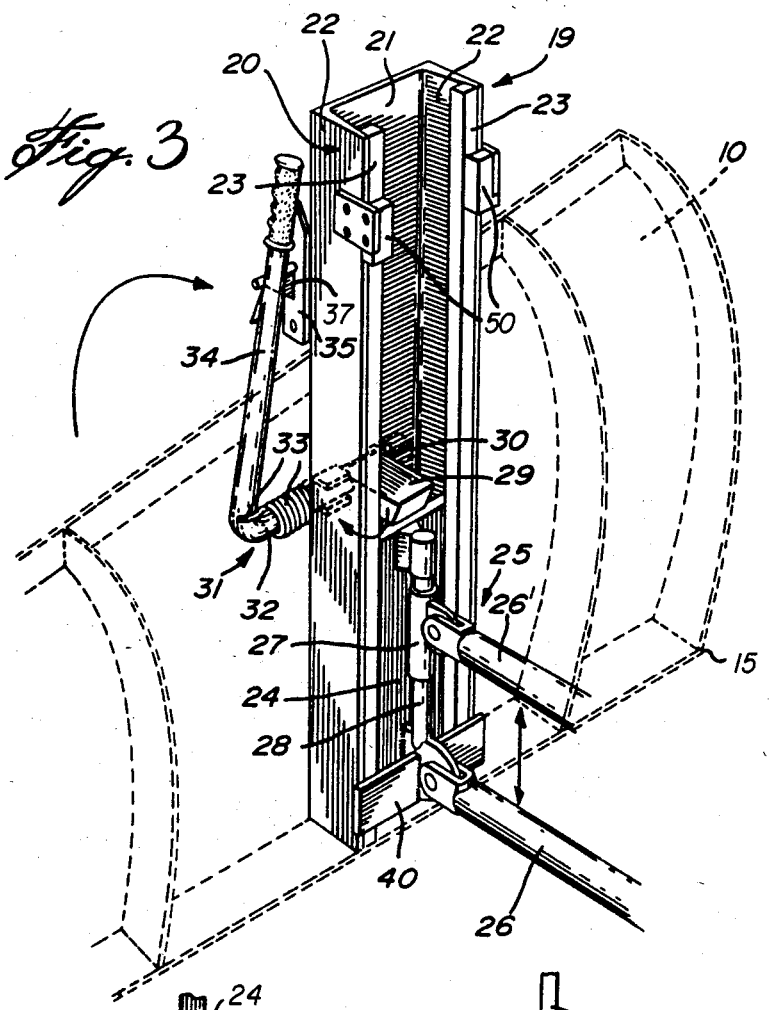
FIG. 3 is an enlarged perspective view showing the construction of the side wing plow positioner of the present invention mounted on the wing plow adjacent the discharge end of the plow which is shown by dotted lines.
Figure 4:
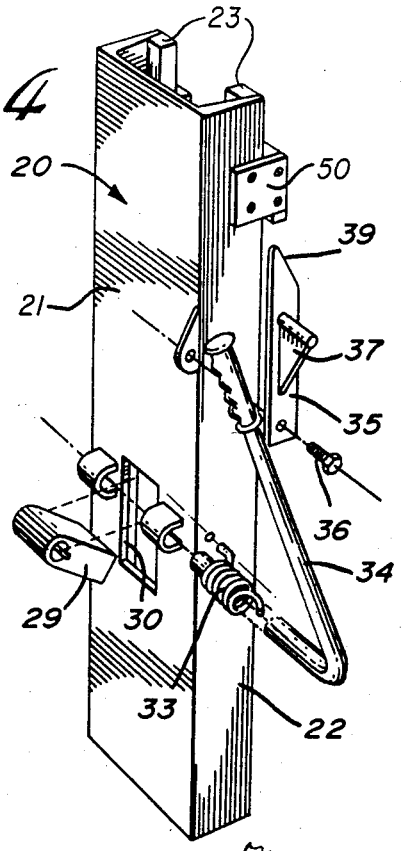
FIG. 4 is an exploded perspective view showing some of the component parts of the side wing plow positioner of the present invention.

Referring now to FIGS. 3 and 4, there will be described the construction of the side wing plow positioner 19. It comprises an elongated guide track 20, secured on the rear face of the wing plow 10 adjacent the discharge end 15, herein an elongated rectangular beam of U-shpaped cross-section having a flat rear wall 21, opposed side walls 22 and inwardly protruding flanges 23 extending from the free edges of the side walls 22. A slide member 24 in the form of a rectangular block, is movable up and down along the guide track 20 by means of a displaceable linkage means 25. As shown in FIG. 3, the linkage means 25 is constituted by a floating hydraulic actuated linkage comprising a lower link arm 26 pivotally secured at a lower end of the slide member 24 and a floating upper arm 26' secured to a sleeve 27 capable of vertical sliding displacement along a guide shaft 28 secured to the outer face of block 24.

Such floating hydraulic actuated linkage does not form part of this invention and is described in U.S. Pat. No. 4,357,766 issued on Nov. 9, 1982. The purpose of this linkage is to absorb vertical shocks imparted on the side wing plow 10 when in use on an irregular surface.

An arresting means in the form of a spring-biased arresting lug 29 is movable in and out of and opening or cavity 30 provided in the rear wall 21 of the track 20 by means of an actuation mechanism 31. The actuation mechanism 31, as seen in FIG. 4, comprises a pivot rod 32 sitably journaled on the outer surface of rear wall 21 and mounted on the arresting lug 29, and a helical torsion spring 33 is secured about the pivot rod 32 to spring bias the arresting lug 29 out of the cavity 30 beyond the inner surface of the rear wall 21, as shown in FIGS. 3 and 6.

Figure 9:
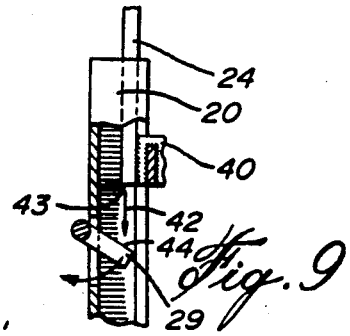
FIG. 9 is a fragmented side view, on a further reduced scale showing the location of the slide member in its uppermost position with respect to the track for retracting the side wing plow against the vehicle.
Figure 6:
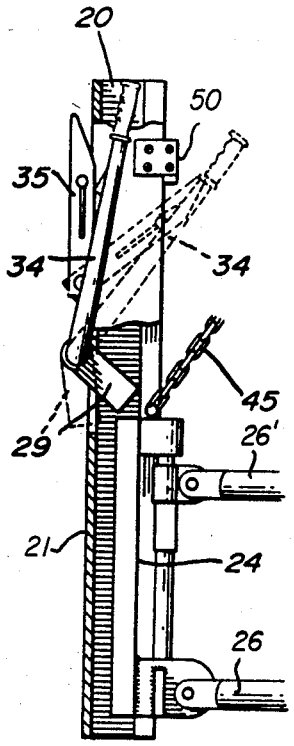
FIG. 6 is a side view of the side wing plow positioner, with portions broken away and incorporating a cable connector.

A manually displaceable lever arm 34 is formed integral with the pivot rod 32 whereby to manually rotate the pivot rod against the spring bias of the helical spring 33 to retract the arresting lug 29 into the cavity 30 whereby to permit the slide member 24 to slide from a lower position, as shown in FIGS. 3 and 6, to an upper retracted position as shown in FIG. 9. The slide member 24, as shown in FIG. 3, is in its position for normal operative use of the wing plow and is prevented from moving upwardly by the arresting lug 29 abutting against the top edge of the slide member 24.

Figure 5:
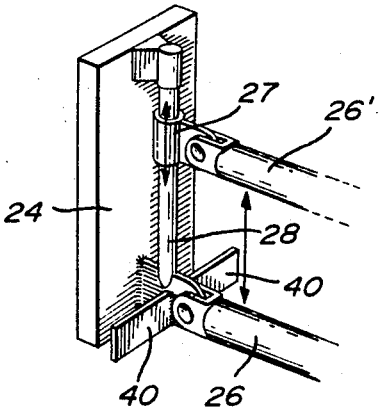
FIG. 5 is a fragmentary perspective view of the slide member having a floating hydraulic actuated linkage connection (see sheet 1 of the drawing)
Figure 8:
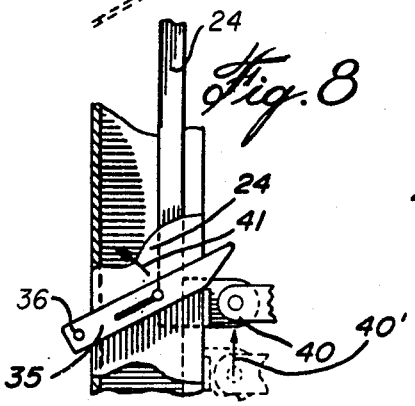
FIG. 8 is a reduced scale fragmented side view showing the location of the pivot lever arm in its engaged position and the location of the trip member.
Figure 7:
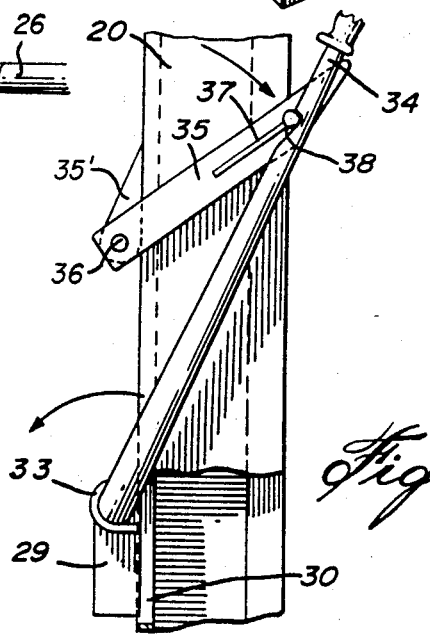
FIG. 7 is an enlarged fragmentary side view illustrating the operation of the pivoted lever arm when engaged with the displacement arm.

Referring to FIGS. 4 and 6 to 9, it can be seen that a pivoted lever arm 35 is pivotally connected on a plate 35' adjacent the side wall 22 of the guide track 20 adjacent the displaceable arm 34 by means of a pivot connection 36. The pivoted lever arm 35 has a brace element 37 secured transversely thereto and constitutes an engaging surface for abutting engagement with a transverse notch 38 (see FIG. 7) provided in the displaceable arm 34 whereby to retain the arm 34 in a forward position (as shown in FIG. 7) to retract the arresting lug 29 into the cavity 30 so as not to obstruct the travel of the slide member 24. The pivoted lever arm 35 is also provided with a disengaging surface 39 at a free end thereof for frictional engagement by a trip member 40 (see FIGS. 3, 5 and 8) when the slide member moves upwardly in the direction of arrow 40'. As shown in FIG. 8, when the slide member 24 moves upwardly in the track 20, the trip member 40 will push the pivoted lever arm 35 upwardly in the direction of arrow 41 causing the brace element 37 to disengage with the transverse notch 3 whereby the spring bias will urge the displaceable arm 34 in the direction of arrow 41 causing the arresting lug 29 to move out of the cavity 30 in its obstructing position as shown in FIG. 9.

With the slide member 24 fully elevated, as shown in FIG. 9, the linkage 16; i.e. arms 26, 26' now extend upwardly of the side plow permitting the side plow to be retracted to a substantially horizontal position as shown in FIG. 2 below the side window 18. When it is necessary to reposition the side plow against a road surface 17, the arms 16 are hydraulically moved towards the ground surface positioning the lower edge of the side plow against the ground. The slide member 24 is still in its retracted or upper position as shown in FIG. 9. With the side plow resting on the ground surface 17, the link arms 16 are further actuated to move the slide member 24 downwardly in the track 20 in the direction of arrow 42. The lower end 43 of the slide member 24 thus abuts the angulated top surface 44 of the arresting lug 29 causing the lug to move into the cavity 30 permitting the passage of the slide member 24 to its lowermost position, as shown in FIG. 3. As soon as the lug is cleared by the top end of the slide member, the lug is again urged outwardly by the spring bias of the helical spring 33, thus automatically locking the slide member in this lower end position. The side wing plow then extends laterally of the vehicle and is thus ready for operation. It can be seen that in order to position the side wing plow 10 to its retracted position, as shown in FIG. 2, it is only necessary for an operator to pull on the displaceable arm 34 and position the pivoted lever arm 35 thereagainst for retaining the arm in its forward position. From then on, the operation of the positioner is fully automatic for retracting the snow plow and placing it again in full operation.

Arresting stop blocks 50 are removably secured to the side walls 22 of the track 20 and limit the upward movement of the slide member 24 by abutting the trip member 40. To remove the slide member 24, these blocks 50 are removed and the slide member is then free to move out of the track top end.

Referring now to FIG. 6, there is shown a different displaceable linkage means, and herein constituted by a cable connection 45 suspended from a vehicle side boom 46 as shown in FIG. 1. Such support cable constitutes a shock absorbing support for the side wing plow.

It is within the ambit of the present invention to cover any obvious modifications of the example of the preferred embodiment described herein, provided such modifications fall within the scope of the appended claims. For example, the construction of the track member and slide member may be made differently than that illustrated. The track could be, for example, an I-beam with the slide member having a T-slot therein for sliding displacement along the I-beam. The arresting lug could be mounted in a wing of the I-beam or a double lug could be mounted in both wings of the I-beam. Also, the pivoted lever arm may be spring-loaded for automatic engagement with the displaceable arm when pulled to its forward position. The spring force on the pivoted lever arm would be less than the spring bias on the displaceable arm whereby to effect the retraction of the arm by the spring bias. These are but suggestions of possible modifications and others are quite conceivable.

We claim:

1. In combination, a vehicle having a cab and side window, a side wing snow plow, means connected between said vehicle cab and said side wing snow plow for positioning the side wing snow plow from a laterally-extending operative position to a retracted inoperative position, the improvement comprising: a side wing plow positioner for locating the wing plow in a retracted position against the whicle cab without obstructing vision from the adjacent side window and automatically locating the side wing plow in a laterally-extending operative position relative to the passenger cab of said vehicle, said positioner comprising an elongated guide track secured to and extending substantially vertically to a rear portion of said wing plow adjacent a discharge end thereof and from a lower edge therefrom, a slide member engaged with said track for limited longitudinal, vertical displacement therealong, arresting means to retain said slide member in a lowermost position in a lower end portion of said track, displaceable linkage means secured to said slide member for displacing said slide member along said guide track, said arresting means having an automatic actuation mechanism to arrest said slide member in said lower end portion of said track when the slide member is in its lowermost position.

2. The structure as claimed in claim 1, wherein said arresting means is a spring biased arresting lug movable in and out of an inner surface of a wall of said guide track to abut against said slide member to prevent displacement thereof in said guide track.

3. The structure as claimed in claim 2, wherein said arresting lug is secured to a pivot rod for pivotal movement of said lug in and out of a cavity provided in a rear wall of said guide track, and a torsion spring secured to said pivot rod to spring bias said arresting lug out of said cavity above said inner surface, said torsion spring constituting said automatic actuation mechanism.

4. The structure as claimed in claim 3, wherein a displaceable arm is secured to said pivot rod to rotate same against said spring bias to retract said arresting lug in said cavity below said inner surface, and lever means engageable with said displaceable arm to retain said arm and maintain said arresting lug in said cavity.

5. The structure as claimed in claim 4, wherein said lever means is a pivoted lever arm having an engaging surface for abutting engagement with said displaceable arm to retain said arm in position to maintain said arresting lug retracted in said cavity, and a disengaging surface for frictional engagement by a trip member secured to said slide member to disengage said lever arm from said displaceable arm whereby said spring bias will displace said displaceable arm to move said arresting lug out of said cavity.

6. The structure as claimed in claim 5, wherein said engaging surface is a transverse element secured to said lever arm and engageable in a transverse notch formed in said displaceable arm, said disengaging surface being an outwardly angulated end edge of said lever arm.

7. The structure as claimed in claim 5, wherein a stop element is secured to said guide track to restrict the upward sliding displacement of said slide member.

8. The structure as claimed in claim 7, wherein said stop element is at least one removable block secured to said guide track for abutment by said trip member secured to said slide member, said stop element when removed permitting said slide member to be removed from said guide track.

9. The structure as claimed in claim 8, wherein said guide track is an elongated rectangular beam of U-shape cross-section having a flat rear wall, opposed side walls, and inner protruding flanges at a free end of said side walls; said cavity being located in said rear wall, said pivoted lever arm being pivotally secured to one of said side walls adjacent said displaceable arm, said slide member being a rectangular plate captive behind said inner protruding flanges.

10. The structure as claimed in claim 1, wherein said displaceable linkage means is constituted by a floating hydraulic actuated linkage secured to said slide member and a side frame of said vehicle.

11. The structure as claimed in claim 1, wherein said displaceable linkage means is constituted by a support cable secured to said slide member and a side frame of said vehicle.

12. The structure as claimed in claim 1, wherein said displaceable linkage means is secured to a side frame of said vehicle and actuable to retract said wing plow to a retracted position adjacent a side of said vehicle, said positioner permitting said wing plow to be maintained substantially horizontal in said retracted position without obstructing vision from an adjacent side window in a passenger cab of said vehicle.

* * * * *

UNITED STATES PATENT AND TRADEMARK OFFICE

CERTIFICATE OF CORRECTION

PATENT NO. : 4,596,081

DATED : June 24, 1986

INVENTOR(S) : Jacques DeBilly and Daniel Depault and Bertrand Houle

It is certified that error appears in the above-identified patent and that said Letters Patent are hereby corrected as shown below: Item [75] should read as follows:

-- Inventors: Jacques DeBilly, St.Valerien; Daniel Dépault, Upton; Bertrand Houle, Drummondville all of Canada --.

Signed and Sealed this

Seventh Day of October, 1986

[SEAL]

*Attest:*

DONALD J. QUIGG

*Attesting Officer*

*Commissioner of Patents and Trademarks*